US008356650B2

(12) United States Patent
Takahashi et al.

(10) Patent No.: US 8,356,650 B2
(45) Date of Patent: Jan. 22, 2013

(54) WORKING APPARATUS FOR PASTING CONTINUOUS PAPER WEBS TOGETHER

(75) Inventors: Toshihiro Takahashi, Yokote (JP); Toshihiro Takahashi, Yokote (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 110 days.

(21) Appl. No.: 12/281,817

(22) PCT Filed: May 11, 2007

(86) PCT No.: PCT/JP2007/060175

§ 371 (c)(1),
(2), (4) Date: Sep. 5, 2008

(87) PCT Pub. No.: WO2007/132927

PCT Pub. Date: Nov. 22, 2007

(65) Prior Publication Data

US 2009/0056881 A1 Mar. 5, 2009

(30) Foreign Application Priority Data

May 17, 2006 (JP) ..... 2006-137613

(51) Int. Cl.
*B32B 37/00* (2006.01)
*B32B 38/04* (2006.01)

(52) U.S. Cl. ..... 156/495; 156/516; 156/547; 156/549

(58) Field of Classification Search ..... 156/73.4, 156/163, 171, 184, 238, 269, 430, 547, 264, 156/494–495, 548, 549, 250, 253, 270, 510, 156/516, 517, 519

See application file for complete search history.

(56) References Cited

U.S. PATENT DOCUMENTS
(Continued)

FOREIGN PATENT DOCUMENTS

| | | |
|---|---|---|
| JP | 63-106676 | 7/1988 |
| JP | 2003-095237 | 4/2003 |

(Continued)

*Primary Examiner* — Katarzyna Wyrozebski Lee
*Assistant Examiner* — Scott W Dodds
(74) *Attorney, Agent, or Firm* — Cozen O'Connor

(57) ABSTRACT

A working apparatus for pasting two continuous paper webs together having patterns is provided which can be made small as a whole and whose pasting processing treatment reduces a paper loss occurring when the apparatus starts to operate.

To this end, the apparatus which has an upper paper line 1 along which a continuous upper paper web 2 having a pattern printed thereon is driven to travel by a drive unit, a lower paper line 3 along which a continuous lower paper 4 web having a pattern printed thereon is driven to travel by a drive unit, a pasting unit 5 for pasting the upper and lower paper webs together into a combined paper web 7 while registering the patterns on them with each other, a combined paper line 6 along which the combined paper web 7 is driven to travel by a drive unit and a processing unit disposed in each corresponding one of the lines upstream and downstream of the pasting unit for processing the paper web traveling along the corresponding line, comprises: a paste applying unit 23 disposed in the lower paper line upstream of the pasting unit and whose paste applying operation can be turned on and off; an upper paper winding unit 31 disposed downstream of the pasting unit for winding up the upper paper web passed through the pasting unit; and a drive source provided for each corresponding one of the drive and processing units and operable individually.

5 Claims, 2 Drawing Sheets

U.S. PATENT DOCUMENTS

| | | | | |
|---|---|---|---|---|
| 1,818,459 | A * | 8/1931 | Bryan | 101/219 |
| 2,375,451 | A | 5/1945 | Waters | |
| 4,294,637 | A * | 10/1981 | Rump | 156/157 |
| 5,227,004 | A * | 7/1993 | Belger | 156/552 |
| 5,783,007 | A | 7/1998 | Boyd et al. | |
| 6,207,001 | B1 * | 3/2001 | Steidinger et al. | 156/264 |
| 6,395,120 | B1 * | 5/2002 | Bradbury-Harris et al. | 156/230 |
| 6,539,997 | B1 * | 4/2003 | Lemens | 156/389 |
| 2006/0148358 | A1 * | 7/2006 | Hall et al. | 442/328 |

FOREIGN PATENT DOCUMENTS

| | | |
|---|---|---|
| JP | 2005-193437 | 7/2005 |
| JP | 2005-205597 | 8/2005 |
| WO | WO 88/03089 | 5/1988 |

* cited by examiner

WORKING APPARATUS FOR PASTING CONTINUOUS PAPER WEBS TOGETHER

RELATED APPLICATIONS

This is a U.S. National Phase Application under 35 USC 371 of International Application PCT/JP2007/060175 filed on May 11, 2007.

This application claims the priority of Japanese application no. 2006-137613 filed May 17, 2006, the entire content of which is hereby incorporated by reference.

TECHNICAL FIELD

The present invention relates to a working apparatus for pasting continuous paper webs together whereby two printed continuous paper webs are pasted together while registering their respective patterns with each other and in which they are processed in various ways at both upstream and downstream sides of a pasting section.

BACKGROUND ART

If continuous paper webs pasted together as mentioned above takes a final form in which the continuous paper webs which are printed and processed in given sizes in a direction of their travel are cut in a fixed size, modes such as tension of each continuous paper web traveling through a processing unit need to be kept constant always at a given site. And, during the time period in which the processing unit starts to operate, the continuous paper web which has traveled until the mode becomes constant comes to be a loss. For this reason, the time period (distance of paper travel) until the mode of a continuous paper web becomes constant is desirably as short as possible.

Until a mode such as the tension of a continuous paper web traveling along a line of travel having a processing unit comes to be maintained always constant at a given site, namely until it arrives at a constant equilibrium state thereof, the continuous paper web needs to be driven to travel over a certain time period depending on an amount of delivery of the continuous paper web from its supply section, a peripheral speed thereof on a feed roll at a given site in the travel path, a slip factor of the traveling continuous paper web with a surface of the roll and a property of the continuous paper web on its expansion and contraction.

And, in the state that continuous paper webs prior to pasting are driven to travel to a pasting unit as they remain unstable in their tension, the continuous paper webs as their traveling itself is unstable tend to cause such as meandering thereof and it takes a considerable time until the state is reached that the continuous paper webs are each driven to travel stably. As a consequence, an increased amount of paper loss occurs that largely exceeds the range of a simple multiple corresponding to the number of continuous paper webs compared with a general apparatus in which a continuous paper web delivered from a single paper roll is processed.

Designed to solve these problems, a working apparatus has been known in which after two continuous paper webs, upper and lower, are pasted together, a pattern that matches a pattern previously printed on the lower continuous paper is printed on the upper continuous paper web so that the pattern of the two continuous paper webs are matched without need to later register them between the continuous paper webs (see, e.g., JP 2003-95237 A).

In this prior art apparatus in which one (upper) continuous paper web is printed after it is pasted on the other continuous paper web, if it is desired that the one continuous paper web be one with a multicolored pattern a plurality of printing units for multicolored printing must be arranged in the apparatus, giving rise to a problem that the entire apparatus becomes large-sized in the direction in which paper webs travel.

Also, in such a working apparatus, if the one continuous paper web is one with a single-colored pattern all printing units other than the one in operation must stand idle, causing a problem that an operation becomes wasteful of equipment.

With the foregoing problems taken into account, it is an object of the present invention to provide a working apparatus for pasting two continuous paper webs together, each having a pattern, which without the need to be equipped with a printing unit downstream of the pasting unit can be made small-sized as a whole and permits the two continuous paper webs when pasted to be registered in pattern with reduced paper loss.

SUMMARY OF THE INVENTION

In order to achieve the object mentioned above, there is provided in accordance with the present invention a working apparatus for pasting two continuous paper webs together, having an upper paper line along which a continuous upper paper web having a pattern printed thereon is driven to travel by a drive unit, a lower paper line along which a continuous lower paper web having a pattern printed thereon is driven to travel by a drive unit, a pasting unit for pasting the upper and lower paper webs together into a combined paper web while registering the patterns on them with each other, a combined paper line along which the combined paper web is driven to travel by a drive unit and a processing unit disposed in each corresponding one of the lines upstream and downstream of the pasting unit for processing the paper web traveling along the corresponding line, wherein the apparatus comprises: a paste applying unit disposed in the lower paper line upstream of the pasting unit and whose paste applying operation can be turned on and off; an upper paper winding unit disposed downstream of the pasting unit for winding up the upper paper web passed through the pasting unit; and a drive source provided for each corresponding one of the drive and processing units and operable individually.

According to this makeup, prior to pasting, the upper paper web is threaded through the upper paper line and its downstream end is wound on a pasting roll in the pasting unit and connected to the upper paper winding unit. Then, the drive, the processing and the upper paper winding units for the upper paper line are driven each individually and synchronously with one another, causing the upper paper web to travel while adjusting its tension. The upper paper web then traveling is wound up on the upper paper winding unit. The upper paper web when the state is reached that it becomes stable in tension by this traveling adjustment is brought to a halt.

On the other hand, the lower paper web in the state that the paste applying unit is held off from its pate applying operation is threaded through the lower and combines paper lines, and the drive and the processing units for the lower and combined paper lines are driven each individually and synchronously with one another, causing the lower paper web to travel while adjusting its tension. The lower paper web when the state is reached that it becomes stable in tension by this traveling adjustment is brought to a halt.

Thereafter, the upper paper web is finely moved in the direction of its travel to register the pattern on the upper paper web with that on the lower paper web. Subsequently, with the paste applying unit turned on for its paste applying operation to apply paste to the lower paper web, the upper paper web and the lower paper web are driven slowly to travel synchronously with each other and pasted together at the pasting unit. Then, with the units de-actuated, the upper paper web is cut off at a downstream of the pasting unit.

Then, with the drive and processing units for the entire apparatus driven synchronously with one another, the upper and lower paper webs are each processed and pasted together and go on to be further processed and discharged.

Also, in the working apparatus for pasting continuous paper webs together, the processing unit disposed in each corresponding one of the lines upstream and downstream of the pasting unit is removably disposed in the corresponding line.

According to this feature of the invention, the processing units are selectively used to meet the respective processing requirements for the upper and lower paper webs and their combined paper web.

According to the present invention, an upper and a lower paper webs as two continuous paper webs each having a pattern, prior to pasting, are each individually driven to travel along a respective line of travel to stabilize its respective tension after which they are pasted together, permitting their synchronous travel thereafter for processing. Thus, in working to paste two continuous paper webs each having a pattern, the adjustment to register the patterns is facilitated, eliminating the need to print on the upper paper web after pasted to the lower paper web as in the conventional working apparatus for pasting of this sort and thereby solving the problem in the prior art which necessitates printing after pasting.

Also, according to the present invention, the individual tensions of an upper and a lower paper web can be stabilized in the state that they are unpasted, permitting them to be pasted as they are stabilized and the pasted continuous paper webs to travel stably. The result is a large reduction in the percentage of paper loss.

And, according to the present invention, the loss of paper occurring in tension adjustment of continuous paper webs before they are pasted can be to substantially a same extent as that which occurs in a general apparatus in which a continuous paper web delivered from a single paper roll is processed and the loss of paper as in a working apparatus of this sort can thus be significantly reduced.

Also, the loss of paper at the final adjustment by the time normal products are issued after an upper and a lower paper web are adjusted in tension, pasted together and initiated to travel can be largely reduced by both paper webs having before then been each individually adjusted into a stable state.

And, since the continuous paper webs respectively traveling in the upper and lower paper lines have been made stable, both paper webs after they are pasted together are made readily adjustable, thereby shortening the preparatory time period for issuance of normal products and hence enhancing their productivity.

Further, according to the present invention, the preparatory operation is made easy so that anyone who has a general skill is capable of operating the apparatus. Moreover, differences in quality due to degrees of skill of operators are reduced and products can be produced at a uniform quality.

Also, made up as mentioned above, the working apparatus for pasting continuous paper webs together allows specifications of processing treatment to be recombined for different lines by using a processing unit or units selectively for each of the lines.

BEST MODES FOR CARRYING OUT THE INVENTION

Figure 1:
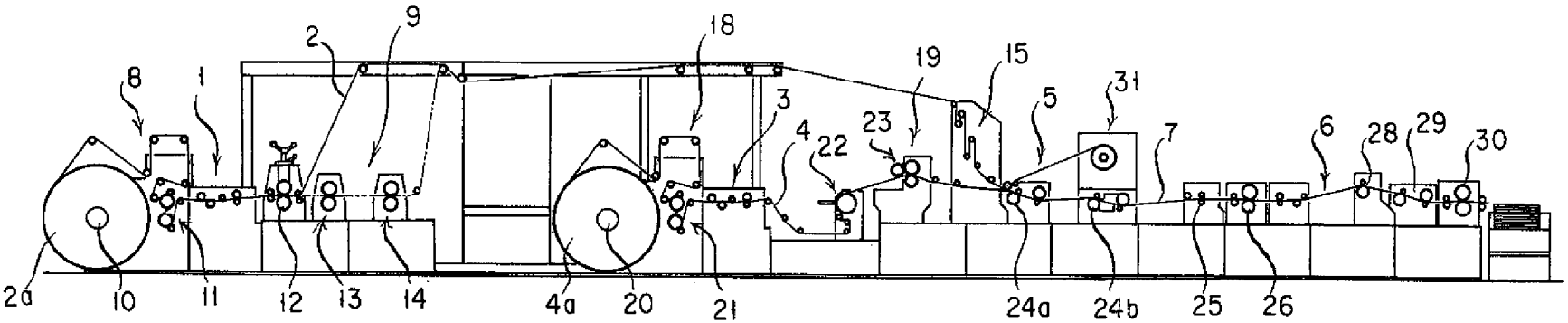
FIG. 1 is a front general view illustrating a working apparatus for pasting continuous paper webs together in accordance with the present invention.
Figure 2:
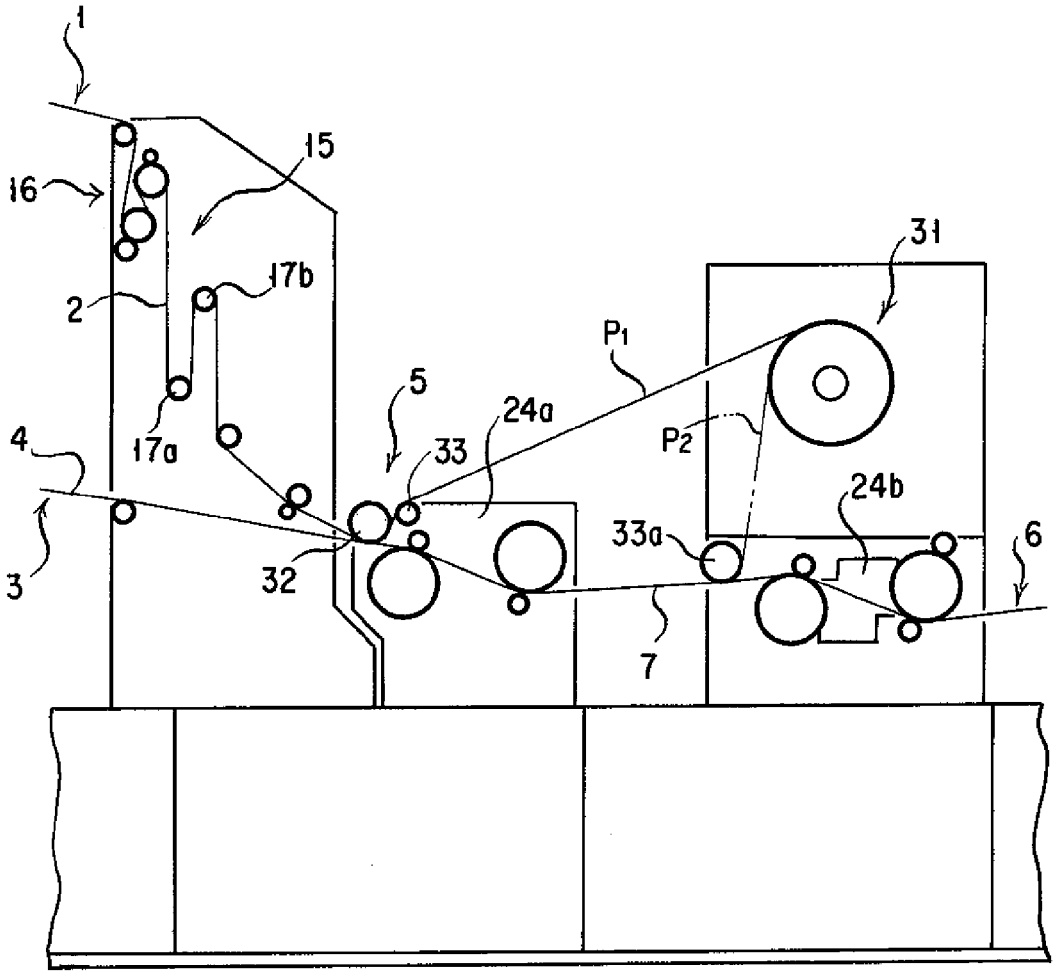
FIG. 2 is an explanatory view illustrating as enlarged a pasting unit of the working apparatus for pasting continuous paper webs together.

FIG. 1 is a general front view diagrammatically illustrating an apparatus for pasting two continuous paper webs together according to the present invention and FIG. 2 is an explanatory view diagrammatically illustrating as enlarged a unit for pasting continuous paper webs together.

In FIG. 1, there are shown an upper paper line 1 along which an upper paper web 2 as an upper continuous paper web is driven to travel and a lower paper line 3 along which a lower paper web 4 as a lower continuous paper web is driven to travel. These two lines 1 and 3 are arranged parallel to each other up and down at their upstream side and are joined at a pasting unit 5 into a combined paper line 6 along which a combined paper web 7 consisting of the upper and lower continuous paper webs 2 and 4 pasted together is driven to travel.

The upper paper line 1 has an upper paper supply section 8 for supplying the upper paper web 2 from an upper paper roll 2*a* and an upper paper processing section 9 for working the upper paper web 2 supplied from the upper paper supply section 8. And, the upper paper supply section 8 comprises a support shaft 10 that supports the upper paper roll 2*a* and has a built-in brake unit such as of powder brake, and an upper paper feed roll unit 11 that pulls the upper paper web 2 out of the upper paper roll 2*a* supported by the support shaft 10, against a braking force exerted by the brake unit to feed the upper paper web 2 towards the downstream side. Also, the upper paper processing section 9 comprises a die-cut roll unit 12 for die-cutting the upper paper web 2, a perforating unit 13 for making form and margin perforations and a slitter 14 for making a slit in a direction of travel. The upper line 1 is also provided at its downstream side with a tensioner 15 for adjusting the phase of upper paper web 2 in its traveling direction. The tensioner 15 as shown in FIG. 2 comprises a feed roll unit 16 and guide rollers 17*a* and 17*b* for fine adjustment of the path length of the upper paper web 2 in its traveling direction.

The lower paper line 3 like the upper paper line 1 has a lower paper supply section 18 for supplying lower paper web 4 from a lower paper roll 4*a* and a lower paper processing section 19 for working the lower paper web 4 supplied from the lower paper supply section 18. And, the lower paper supply section 18 comprises a support shaft 20 and a lower paper feed roll 21 configured as in the upper paper supply section 8. Also, the lower paper processing section 19 comprises a coater for overcoating the surface of lower paper web 4 with a coating composition and a paste applying unit 23 for applying a paste in a given pattern. The paste applying unit 23 is turned on and off for a paste applying operation.

Further, the combined paper line 6 is provided with a first and a second combined paper feed roll unit 24*a* and 24*b* whereby the combined paper web 7 pasted at the paste applying unit 5 is driven to travel at a given tension, a slitter 25 for slitting the combined paper web 7, a perforating unit 26 for making form and margin perforations on the combined paper web 7, a marking unit 28 that applies a mark on the combined paper web 7, a tow roll unit 29 whereby the combined paper web 7 traveling along the combined paper line 6 is pulled under a given tension at its downstream side, and a cutting unit 30 for cutting the combined paper web 7 at a given spacing.

Downstream of the pasting unit 5 and above the combined paper line 6 there is provided an upper paper winding unit 31.

The pasting unit 5 as shown in FIG. 2 comprises a pasting roll 32 disposed in a travel path continuous from the lower paper line 3 to the combined paper line 6 and a guide roll 33 disposed downstream of the pasting roll 32 and above the combined paper line 6. The pasting roll 32 and the guide roll 33 are made freely rotatable.

As regards each of the paper lines 1, 3 and 6, it should be noted that drive units such as the upper paper feed roll unit 11 for driving the upper paper web 2 to travel in the upper paper line 1 and the feed roll unit 16 for the tensioner 15, the lower paper feed roll 21 for driving the lower paper web 4 to travel in the lower paper line 3 and further the combined paper feed roll units 24*a* and 24*b* and the tow roll unit 29 in the combined paper line 6 are designed to be each driven controllably by a servo motor rotated controllably in a single or individual drive system.

Also in each of the paper lines 1, 3 and 6, processing units such as the perforating unit 13 and the slitter 14 in the upper paper line 1, the coater 22 and the paste applying unit 23 in the lower paper line 3 and further the slitter 25, the perforating unit 26 and the marking unit 28 in the combined paper line 6 are designed, as are the drive units, to be each driven controllably by a servo motor rotated in an individually operable drive system. Further, these processing units are each adapted to be attached and detached selectively in each paper line 1, 3, 6.

Also, each of the drive units and each of the processing units are made operable selectively upon an operation on a touch panel.

With the apparatus so made up as mentioned above, an upper paper web 2 and a lower paper web 4 which are previously printed with patterns and taken up on the upper and lower paper rolls 2*a* and 4*a*, respectively, are pasted together while registering the patterns with each other in an operation as described below.

The upper paper roll 2*a* and the lower paper roll 4*a* are set, respectively, on the support shaft 10 in the upper paper supply section 8 and on the support shaft 20 in the lower paper supply section 18. And, the upper paper web 2 is delivered from the upper paper roll 2*a* to pass through the upper paper line 1 so that its downward end passes below the pasting roll 32 in the pasting unit 5 and then connects to the upper paper winding roll unit 31 for its take-up.

Also, the lower paper web 4 is delivered from the lower paper roll 4*a* to pass through the lower paper line 3 and then to pass below the pasting roll 32 in the pasting unit 5 and is thereafter passed though the combined paper line 6. Then, for the paste applying unit 23 its paste applying operation is left off. Also, a paper path is set so that the lower paper web 4 is in light contact with the upper paper web 2 wound on the pasting roll 32 below the pasting roll 32.

Paper threading into each line 1, 3, 6 is effected upon operating the touch panel to inch or slowly drive the corresponding drive and processing units each of which is brought to a halt after the paper web is threaded.

Next, in the state that the paper web is threaded into each line 1, 3, 6, the upper paper line 1 and the line extending from the lower paper line to the combined paper line are operated individually.

For example, with the drive and processing units for the upper paper line 1 brought into their normal operating state, the upper paper web 2 is allowed to travel through the upper paper line 1 and to be pulled by and taken up on the upper paper winding unit 31. This causes the upper paper web 2 fed from the upper feed roll unit 11 in the upper paper supply unit 8 to be die-cut by the die-cut roll unit 12, processed as desired by the perforating unit 13 and the slitter 14 and, having traveled through the feed roll 16 and the guide rolls 17*a* and 17*b*, . . . in the tensioner 15 and through the pasting roll 32, to be towed and taken up on the upper paper winding unit 31.

Then, the operating speed of each unit for the upper paper line 1 is finely adjusted individually by operating the touch panel to stabilize the tension on the upper paper web 2 extending from the upper paper feed roll 11 to the upper paper winding unit 31. When a state is reached that the tension is stabilized, the upper paper line 1 is ceased to operate.

Subsequently, with the paste applying unit 23 held off from its pasting operation, the drive units together with the processing units in the lower paper line 3 and the combined paper line 6 continuous therewith are brought into their normal operating states, permitting the lower paper web 4 to run. This causes the lower paper web 4 fed from the lower paper feed roll 21 in the lower paper supply unit 18 to travel while being processed as desired by the processing units in the lower paper line 3 and the combined paper line 6 as is the case with the upper paper web 2 in the upper paper line 1. The lower paper web 4 then is allowed to travel while slipping from the upper paper web 2 wound on the pasting roller 32 in the pasting unit 5.

And, then the operating speed of each of the units in the lower and combined paper lines 3 and 6 is finely adjusted individually by operating the touch panel to stabilize the tension on the lower paper web 4 extending from the lower paper feed roll 21 to the cutting unit 30. When a state is reached that the tension is stabilized, the lower and combined paper lines 3 and 6 are ceased to operate.

In the state that the tensions of the upper and lower paper webs 2 and 4 in their respective lines are stabilized as mentioned above, the guide rollers 17*a* and 17*b* in the tensioner 15 for the upper paper line 1 and the upper paper winding unit 31 are operated to finely adjust the phase of the upper paper web 2 in its traveling direction in the pasting unit 5 so as to register the pattern of the upper paper web 2 with the pattern of the lower paper web 4 vertically. Thereafter, the paste applying unit 23 is turned on for its paste applying operation and the upper and lower paper webs 2 and 4 are driven to slowly travel synchronously. This allows the upper and lower paper webs 2 and 4 to be pasted together by the pasting unit 5 with paste applied on the lower paper web 4. Then, with the operation terminated, a portion of the upper paper web 2 not pasted with the lower paper web 4 is cut off at a downstream side of the pasting unit 5, e.g., by a cutter. It is also possible, at that point of time where the patterns on the upper and lower paper webs 2 and 4 are registered with each other, to cut off the upper paper web 2 at a downstream side of the pasting roll 32, to connect the end of the upper paper web 2 to the lower paper web 4 with an adhesive tape, to allow the paper webs to travel slowly and then to draw paste from the paste applying unit 23, thereby pasting the two paper webs 2 and 4 together.

It follows, therefore, that the state has been reached that the upper and lower paper webs 2 and 4 with their tension stabilized is pasted together at the pasting unit 5, namely which has been ready for pasting the two paper webs together.

In the state which has been ready as mentioned above, operating those units other than the upper paper winding unit 31 allows the upper and lower paper webs 2 and 4 with their tension stabilized in their respective lines 1 and 3 to be pasted and thereafter to be processed and cut in, and discharged from, the combined paper line 6.

Before the upper and lower paper webs 2 and 4 are pasted together in the way mentioned above they have been individually stabilized in tension. Since it is thereafter that the upper and lower paper webs 2 and 4 are processed so that they are pasted, it is possible to ensure that the pasted continuous paper web is driven to travel stably and thereby to largely reduce a paper loss occurring in initiating the pasting processing operation.

In the form of implementation mentioned above, it should be noted that by removably mounting processing units for the upper and lower paper webs 2 and 4 selectively in their respective lines upstream and downstream of the pasting unit 5, it is possible to variously recombine the processing specifications. Also, the final processing may be a discharge after folding by a folding unit instead of a discharge after cutting.

Also, while in the form of implementation mentioned above the upper and lower paper webs 2 and 4 are pasted by pressing action with the pasting roll 32 in the pasting unit 5, it should be noted that the pasting roll 32 may be made movable upward relative to the pressing action position so that its pressing action can be turned off and that the upper and lower paper webs 2 and 4 can be registered in the turnoff state. In this case, while some misregister may be created due to a slight displacement of the upper paper web 2 when the pasting roll 32 is moved down to take the pasting position, its adjustable amount may in advance be factored in the tensioner 15.

Also, while in the form of implementation mentioned above, the path downstream of the pasting unit 5 as the path for the upper paper line 1 is shown to be a path $P_1$ extending from its pasting roll 32 via the guide roll 33 to the upper paper winding unit 31, it should be noted that this path may be replaced by a path $P_2$ extending from the pasting roll 32 to its downstream combined paper feed roll unit 24*a* and then from the latter via a guide roll 33*a* to the upper paper winding unit 31.

With the path $P_2$ adopted for the line 1, the pasted distance in the pasting preparation operation from the point where the upper and lower paper webs 2 and 4 are pasted up to the point where the upper paper web 2 is cut off is lengthened as from the pasting roll 32 up to the guide roll 33*a* so that the upper paper web 2 as it is cut off down-stream of the guide roller 33*a* becomes harder to peel off the lower paper web 4.

What is claimed is:

1. A working apparatus for pasting two continuous paper webs together, the working apparatus comprising:

an upper paper line along which a continuous upper paper web having a pattern printed thereon is driven to travel by a first drive unit in a travelling direction;

a lower paper line along which a continuous lower paper web having a pattern printed thereon is driven to travel by a second drive unit;

a pasting unit for pasting the upper and lower paper webs together into a combined paper web while registering the patterns on upper and lower paper webs with each other;

a combined paper line along which the combined paper web is driven to travel by a third drive unit;

a processing unit disposed in each of the upper and lower paper lines upstream, and downstream of said pasting unit for processing said paper web traveling along the corresponding line;

a paste applying unit disposed in said lower paper line upstream of said pasting unit and whose paste applying operation can be turned on and off;

a tensioner disposed in said upper paper line upstream of said pasting unit for fine adjustment of path lengths of said upper paper web in its traveling direction;

an upper paper winding unit disposed downstream of said pasting unit for winding up the upper paper web passed through the pasting unit; and a drive source provided for each corresponding one of said first, second and third drive units, processing units, tensioner, and upper paper winding unit and operable individually;

wherein said upper paper line is configured to allow individual travel of the upper paper web through said upper paper line and said pasting unit to said upper paper winding unit while adjusting tension in the upper paper web, and to allow the upper paper web to be brought to a halt when the tension in the upper paper web is stabilized, wherein said lower paper line is configured to allow individual travel of the lower paper web through said lower paper line and said pasting unit to said combined paper line while adjusting tension in the lower paper web, and to allow the lower paper web to be brought to a halt when the tension in the lower paper web is stabilized, wherein said tensioner and said upper paper winding unit are operable to move the upper paper web to register its pattern with the pattern on the lower paper web in said pasting unit, wherein said pasting unit operates to paste the upper and lower paper webs together into the combined paper web at said pasting unit, wherein a portion of the upper paper web not pasted with the lower paper web is cut off by a cutter at a downstream side of said pasting unit, and wherein the combined paper web is thereafter traveled and processed in said combined paper line by operating the units other than said upper paper winding unit.

2. The working apparatus for pasting continuous paper webs together according to claim 1, wherein said processing unit disposed in each of the upper and lower paper lines upstream, and downstream of said pasting unit is removably disposed in a corresponding line.

3. The working apparatus for pasting continuous paper webs together according to claim 1, wherein the processing unit comprises an upper paper processing section disposed in the upper paper line and comprising at least one of a die-cut roll unit for die-cutting the upper paper web, a perforating unit for making form and margin perforations, and a slitter for making a slit in a direction of travel.

4. The working apparatus for pasting continuous paper webs together according to claim 1, wherein the processing unit comprises a lower paper processing section disposed in the lower paper line and comprising at least one of a coater for over coating a surface of lower paper web with a coating composition and a paste applying unit for applying a paste to form the pattern in the lower paper line.

5. The working apparatus for pasting continuous paper webs together according to claim 1, wherein the processing unit disposed in the combined paper line comprises at least one of a slitter for slitting the combined paper web, a perforating unit for making form and margin perforations on the combined paper web, a marking unit applying a mark on the combined paper web, and a cutting unit for cutting the combined paper web.

* * * * *